United States Patent [19]

Smith

[11] Patent Number: 4,777,889

[45] Date of Patent: Oct. 18, 1988

[54] FLUIDIZED BED MASS BURNER FOR SOLID WASTE

[76] Inventor: Richard D. Smith, 2415 South Ct., Palo Alto, Calif. 94301

[21] Appl. No.: 53,868

[22] Filed: May 22, 1987

[51] Int. Cl.[4] ..... F23G 5/00; F23G 7/00

[52] U.S. Cl. ..... 110/245; 110/346; 122/4 D

[58] Field of Search ..... 122/4 D; 431/170, 7; 110/245, 263, 347, 346; 34/57 A; 165/104.16; 432/58

[56] References Cited

U.S. PATENT DOCUMENTS

| | | | |
|---|---|---|---|
| 3,589,313 | 6/1971 | Smith | 110/8 |
| 3,882,798 | 5/1975 | Reese | 110/8 F |
| 3,921,544 | 11/1975 | Reese | 110/8 F |
| 3,922,975 | 12/1975 | Reese | 110/8 F |
| 4,196,676 | 4/1980 | Brown et al. | 122/4 D |
| 4,270,468 | 6/1981 | Robinson et al. | 122/4 D X |
| 4,335,662 | 6/1982 | Jones | 110/245 X |
| 4,421,038 | 12/1983 | Goldbach et al. | 110/245 |
| 4,473,032 | 9/1984 | Maintok | 122/4 D |

*Primary Examiner*—Edward G. Favors

[57] ABSTRACT

A fluid bed combustion apparatus for burning heterogeneous solid waste material and being particularly adapted for burning light, bulky combustible materials usually found in municipal waste. The apparatus includes means for removing a portion of the fluid bed, cooling it below the ignition temperature of the waste material and delivering it atop the incoming waste material so as to submerge the waste material and to confine its combustion within the fluid bed.

12 Claims, 1 Drawing Sheet

FLUIDIZED BED MASS BURNER FOR SOLID WASTE

FIELD OF THE INVENTION

My invention relates to an improved fluidized bed combustor for burning waste comprising combustible materials and inert foreign objects. The combustor is particularly adapted for burning light, bulky combustible materials as well as heavy, high density materials in an efficient manner.

BACKGROUND OF THE INVENTION

One method of disposing of municipal solid waste and industrial solid waste is to incinerate it. Incinerators have been developed in Europe whereby the bulky solid waste is burned on grates of a wide variety of designs. These incinerators are large, expensive and inefficient, requiring large amounts of excess air to effectively burn the solid waste to completion.

Municipal solid waste is composed of large quantities of paper and plastic, as well as inerts such as bottles, cans, and various foreign objects which are not burned, but whose state may be physically or chemically altered. On average the waste composition is as follows: combustibles 44%, moisture 32%, and inerts 24%. Its average net heating value is perhaps 3500 BTU/lb. It can be expected that the composition of municipal solid waste has great variability from load to load; for example, one load may contain predominantly wet leaves while another load may be laced with magnesium chips, and yet another may contain discarded home appliances such as a refrigerator or a washing machine. Each of the above loads would have dramatically different combustion characteristics. In addition, the combusted materials may create air pollutants in the exhaust gas, such as $SO_2$ from the sulfur in rubber wastes and HCl from the chlorine in PVC plastics.

Industrial solid waste can contain all of the same constituents as are found in municipal solid waste, but usually its composition is more closely defined, because it is generated from a given manufacturing process of a single business activity. An incinerator that can successfully burn heterogeneous municipal solid waste can usually burn almost any tupical homogeneous industrial solid waste. Hereafter I will refer to municipal solid waste. This term is meant to include primarily municipal solid waste but also most industrial solid wastes.

Municipal solid waste is an exceedingly difficult fuel to burn efficiently and cleanly because its different elements have such different combustion characteristics. For example, the wet leaves, having a high moisture content, must be thoroughly dried before combustion can commence, the magnesium chips are highly combustible and will burn explosively at an extremely high temperature of about 5500° F., and the inerts such as glass will melt and corrosively attack the walls of the incinerator.

Fluidized bed combustors are well known in the art and are ideally suited to burning municipal waste. A bed of dry sand, perhaps three feet deep, is levitated by air blowing up through it, introduced by a large number of small orifices at its base. This airflow causes the sand to be partially suspended, giving it the property of partial weightlessness. The result is that the sand moves about freely, similar to a liquid. In operation, the sand is preheated above the auto-ignition temperature of average municipal solid waste and the waste is added to the sand bed where it burns within the bed supplying heat to the sand to make up for the cooling effect of the fluidizing air. The bubbling fluid bed is a large churning mass of red hot fine particulate, with air blowing up through it, which surrounds each component of the solid waste mixture, individually providing uniform heating and airflow for as long as required to combust it. Thus, a rubber heel can take perhaps five minutes to burn to completion while a dry piece of paper will burn in a second. Consequently, the fluid bed combustor has the property of variable retention times for fuels of varying combustion characteristics assuring complete burnout of the waste fuel.

Furthermore, combustion rates of solids in a fluid bed are considerably enhanced by the turbulent hot sand rubbing against the fuel surfaces. Heat transfer from the particulate to the burning surface can be five times greater than in a conventional burner and the particulate grinds char from the burning surface, exposing virgin material for new combustion.

In addition, the fluid bed combustor can operate at a near uniform temperature and can get good combustion efficiency at temperatures of 1450° F. which is below the melting temperature of glass and other inerts. Further, the large thermal mass of the sand acts to drive moisture from wet loads (the wet leaves or wet telephone books) and absorbs bursts of energy from active chemicals (the magnesium chips). It acts as a thermal flywheel, i.e. the bed remains at nearly uniform temperature (±5° F.).

Finally, the fluid bed combustor will suppress the formation and escape of gas pollutants from the burning solid waste by absorbing the sulfur and chlorine in the inert particulate of the bed. Alkaline oxides in the ash, which may come from added limestone or from kaolin in paper burned in the bed, will produce sulfate and chloride salts which remain in the bed.

All of these advantages of incinerating municipal solid waste in a fluid bed have not been realized in practice because of the difficulties of feeding the municipal solid waste into the fluid bed, distributing it uniformly throughout the bed and causing it to burn below the surface of the bed. Problems arise because most of the combustibles in municipal solid waste are plastics and other low density materials that burn relatively rapidly once ignited, and especially so in the interior of the fluid bed. The first problem is to get these light materials into the bed to initiate combustion. If the municipal solid waste is distributed over the surface of the bed, as is coal, the light material will sit on the surface of the bed and burn in the freeboard over the bed. The heat from combustion will not get into the bed, which will slowly cool until it drops below the ignition temperature of the paper, at which time the paper burning over the bed will no longer ignite.

In addition to disposal of solid waste, most municipalities have the added problem of disposing of sewage sludge, which has a very high moisture content and little hearing value. In general, it cannot be burned autogenously. If this sewage sludge were to be fed into a conventional incinerator it would put out the fire. However, because of the excellent combustion characteristics of the fluid bed combustor, it will be cleanly incinerated with perhaps some loss in steaming capacity due to its exothermic nature.

Brown et al in U.S. Pat. No. 4,196,676 teach a fluidized bed for burning log yard waste from a wood products plant whereby the bed burns large and small pieces of wood and is designed to purge itself of the large number of inerts (rocks, for example) that are fed to it along with the log yard waste. Fluidizing air is given a velocity vector toward one side of the combustor for moving inerts to that side. Removal of these inerts is essential because if they accumulated in the bed, the fluidizing action of the bed would cease.

Smith et al in U.S. Pat. No. 3,589,313 and Reese in U.S. Pat. No. 3,922,975 each teach burning municipal solid waste in a fluid bed combustor. However, in each reference the municipal solid waste is preprocessed, for the purpose of removing many of the inerts and making the waste more homogeneous. Then the waste is introduced into the fluid bed below its surface, entrained in air jet. Preprocessing of municipal solid waste is prohibitively expensive and delivering the waste into the fluid bed, below its surface, through the usual inlet pipes is not practical because of the large irregular size of many of its constituents.

It is, therefore, the primary object of my invention to provide a unique fluid bed combustor which will operate efficiently with raw, un-preprocessed, heterogeneous municipal waste and, in particular, light bulky combustible materials, burning the waste within the fluid bed of particulate.

It is a further object of my invention to provide the combustor with inert removal apparatus to continuously purge the bed of inert foreign objects.

Another object of my invention is to provide a combustor which is smaller and cleaner than current designs.

SUMMARY OF THE INVENTION

These and other objects may be carried out, in one form, by providing a fluid bed combustion apparatus including a combustion chamber, an air pervious support within the chamber, a quantity of finely divided inert particles disposed upon the support, a supply of fluidizing air delivered into the chamber beneath the support for forming a fluid bed of the inert particles, a delivery chute for introducing un-preprocessed combustible waste material into the chamber onto said fluid bed, and a flue for venting the products of combustion out of the chamber. My invention is further characterized by comprising an outlet for removing a portion of the inert particles from the fluid bed, and a transport for moving the removed inert particles through a cooling mechanism for reducing the temperature of the inert particles to a temperature below the ignition temperature of the combustible material, and for delivering the cooled inert particles atop the delivered combustible material so as to submerge the combustible material into the fluid bed.

DETAILED DESCRIPTION OF THE ILLUSTRATED EMBODIMENT

Figure 1:
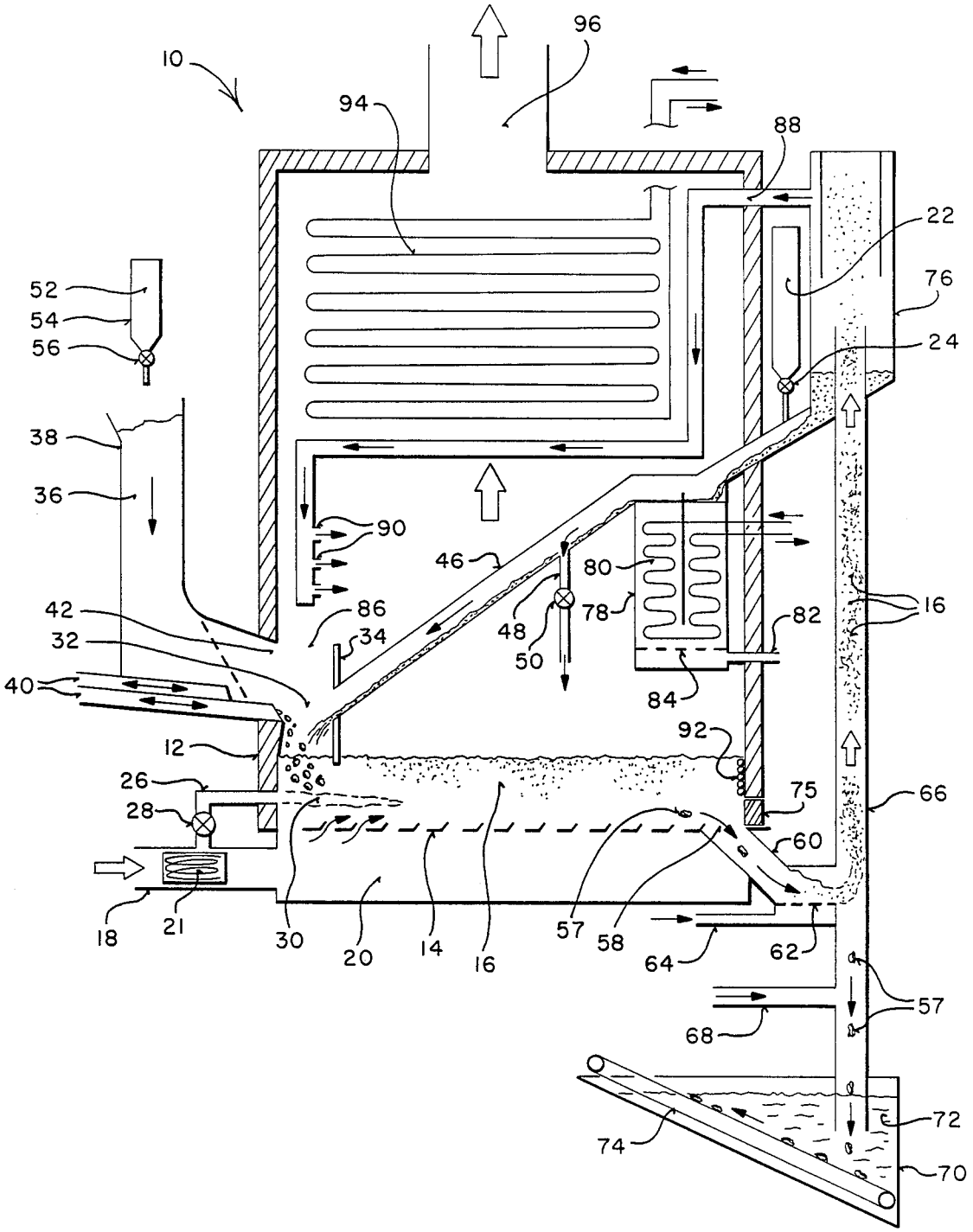
FIG. 1 is a schematic elevation view illustrating the fluid bed combustion apparatus constructed in accordance with my invention.

While it will be appreciated from the following detailed description that the present invention has a number of different aspects which are applicable to combustion of different types of materials in fluid bed reactors, my invention is ideally suited to the combustion of municipal and industrial solid wastes which have great variability of combustion characteristics, notably large quantities of light voluminous combustibles and inert materials as well as high moisture content materials. Typical characteristics of these material is 44% combustibles, 32% moisture and 24% inerts. The combustible fraction has the characteristic of a fuel with a formula $C_{30}H_{48}O_{19}$ and a lower heating value of 7,944 BTU/lb.

Because of the excellent combustion conditions in the fluid bed combustor, municipal solid waste can be burned with excess air ratios as low as 50% while conventional municipal waste mass burners require excess air ratios upwards of 100%. High excess air ratios require large boiler passes, large gas clean up equipment and large stack losses. A major benefit of the fluid bed mass burner results from its low excess air requirements.

A system for burning such material is illustrated in FIG. 1 which shows a fluid bed reactor or combustion assembly 10 having an upstanding combustion chamber 12 which may be cylindrical or rectangular in planform. A modular design uses a basic rectangular bed module having a dimension of 10 ft×20 ft with the longer dimension extending in the direction of the flow of the inerts from entry to exit. This basic module will have a capacity equivalent to approximately a 200 ton/day municipal incinerator. In this configuration the raw waste is fed in at one end and inerts recovery takes place at the opposite end. By putting these 10 ft×20 ft modules together to form a larger capacity incinerator, four modules would provide an overall bed area of 20 ft×40 ft having a capacity of approximately 800 tons/day, appropriate for a larger city.

The upstanding combustion chamber is provided in the lower interior portion thereof with a porous louvered distributor plate 14 for supporting a bed of inert granular particles 16 such as crystalline beach sand. The height of the fluid bed may be varied from 1 ft to 4 ft depending upon the solid waste being burned. The louvered openings in the distributor plate are sufficiently narrow that bed material will not freely flow through the louvers when the bed is not operating. Air is supplied through pipe 18 to the plenum 20 for flow through the distributor plate 14. As air is introduced upwardly through the openings it will "bubble up" through the sand and its slight directional component will, over time, cause large inerts in the fluid bed to migrate slowly toward and collect against the far wall of the combustor. After several hundred hours of use it can be expected that the composition of the bed material is largely that of glass and other inerts from the municipal solid waste because the sand comminutes with time. Tupically, the bed will grow in size with extended operation because of the large number of inerts in the municipal solid waste fuel. These must be controlled and drained to maintain a constant bed level. When combustion is initiated a burner 21 (typically of propane or other suitable fuel) in the pipe 18 heats the air in order to bring the bed of sand particles up to a temperature of about 1300° F. to 1500° F. Thereafter, the combustion of the waste within the fluid bed maintains the bed at the proper temperature.

A portion of the bed composition will be composed of CaO, from clays in paper, which will react with acid gases to suppress their emission from the bed. Limestone or dolomite may be continuously added to the bed to enrich it with CaO and further prevent any undesireable emission of acid gas. Limestone or Dolomite is stored in a receptacle 22 and slowly added through control valve 24 to the bed at the rate of as little as ½ of 1% of the flow rate of the solid waste to effectively suppress nearly all of the acid gases.

A portion of the air supply through pipe 18 is ducted to one or more air distribution pipes 26, each of which is controlled by a valve 28. These air distribution pipes form the horizontal air jets 30 which break-up and distribute the low density combustibles below the surface of the bed 16. Up to 15% of the total air flow through pipe 22 will flow through the air distribution pipes 26. The horizontal air jets 30 supplied by these pipes originate immediately below the solid waste feed zone 32. The powerful horizontal air jets break up the bulky combustibles and distribute them into the bed for uniform combustion throughout the bed. The air jets actually punch a hole through the fluidized bed due to the momentum of the air flow.

To enable the air jets to distribute the fuel well into the bed, sometimes up to a distance of 15 to 20 feet, auxiliary air jets (not shown) or roofs (not shown) over the air jets within the bed are sometimes required to prevent their dissipation before these extended lengths are achieved.

The solid waste feed zone 32 is a small area of the bed onto which the municipal solid waste is fed. A retaining wall 34 separates this zone from the remainder of the bed to confine the solid waste for immersion into the bed, as will be described. As-received, un-preprocessed municipal solid waste 36 is deposited into incoming feed chute 38 which serves to direct the solid waste to the feeder 40 and to seal the entry opening to prevent escape of flue gas of ingestion of large quantities of outside air. The solid waste feeder, which may be of the double ram type, pushes the solid waste over the edge of the opening 42, allowing it to fall onto the surface of the fluid bed in the solid waste feed zone 32.

Cooled bed material 44 at a temperature of 200° F. to 700° F. cascades down the sand return pipe 46 and falls upon and sinks the incoming solid waste 36 into the fluid bed 16 due to its weight and downward momentum. This prevents ignition of the light solid waste material above the bed where it pyrolysis will not support the temperature maintenance of the bed material. The temperature of the returning bed material 44 is brought below the pyrolysis temperature of the combustible so as to prevent its ignition above the bed, in the waste feed zone 32. The cooled bed material injected into the bed with the solid waste serves to delay ignition of the solid waste within the bed and hence enhance its uniform distribution throughout the bed. Adjustments to the flow rate and temperature of the cooled bed material may be tailored to the composition and combustion characteristics of the incoming solid waste. It may be varied from a fraction of the flow rate of the solid waste to over six times the flow rate of the solid waste. One method of adjusting the flow rate of the cooled bed material 44 onto the incoming solid waste 36 is to divert a portion of the sand directly to the bed 16 through a bypass duct 48, adjusted by a valve 50.

The air jets 30 from the air distribution pipes 26 dissemble the submerged solid waste and distribute it the length of the bed to provide a more or less uniform distribution throughout the bed. Once away from the influence of the air jets, the submerged light voluminous solid waste burns quickly within the hot bed. The jets also provide an oxygen rich zone, which serves to provide added oxygen where needed, i.e. directly below the fuel rich solid waste feed zone.

Complete distribution of the waste material throughout the hot fluid bed provides the improved combustion characteristics of my invention. Therefore, slow burning components of the solid waste fuel may be easily distributed by the normal action of the bed and burn at their leisure until totally consumed. Old shoes and champagne corks are examples of this fuel component. If municipal sewage sludge 52 is fed into the fluid bed combustor, it may be introduced by mixing it directly with the municipal solid waste 36 in the incoming feed chute 38 from feeder 54 controlled by valve 56. The high moisture in the sewage sludge soaks into the paper of the solid waste to reduce its ignitability and hence actually improves its distribution into the fluid bed.

Large size inerts 57, which have been slowly walked across the distribution plate 14 by the directional air through its louvers, and bed material 16 are removed through the outlet port 58 which is located adjacent to the wall opposite the entry of waste material. The removed mixture descends through downcomer 60 at a flow rate controlled by fluidizing air through another distributor plate 62 supplied through line 64. With no air flow, the angle of repose prevents flow of solid material. However, when fluidization occurs in this outlet zone the material flows freely and falls into the lift pipe 66 wherein upward air velocity of approximately 15 ft/sec has been established through air supply pipe 68.

Heavy inerts 57 will not be supported by this low upward air velocity and will fall down into a waste receptacle 70 which uses a water seal 72 to prevent air leakage in to or out of the combustor system. A conveyor 74 continuously removes inerts 57 from the waste receptacle. A waste clean out door 75 is used to periodically remove oversized inerts that will not fit into the downcomer 60.

The bed material 16 injected into the lift pipe 66 is lifted by the vertical air flow to the disengagement vessel 76 where the bed material is separated from the transport air. The bed material flow down into the heat exchanger 78 where it is cooled. A fluid bed heat exchanger is shown transferring heat to steam tubes 80 buried in the bed. Fluidization air is supplied through inlet port 82 and distribution plate 84, and heated dusty air is expelled through sand return pipe 46 and upwardly through opening 86 into the freeboard directly over the solid waste feed zone 32. The bed material may be cooled by any other conventional technique. The heated air, at 1000° F., is a very active oxidant and is transmitted through a duct 88 and injected over the bed through nozzles 90 to aid in the combustion of any fuel rich gases that may have evolved from the bed. The location of the nozzles can be moved to any area over the bed where fule rich gases exist. During lift the bed material (starting at about 1450° F.) is cooled by the lift air (starting at about 150° F.) in concurrent heat transfer. During the transport, the bed material is cooled several hundred degrees while the lift air is heated to perhaps 1000° F.

The range of fluid bed operating temperatures is 1300° F. to 1550° F. with 1450° F. being the best choice. At the lower temperatures combustion efficiency degrades while at the highest temperature glass softens and causes the fluidizing action of the bed to become sluggish, or to stop. Some combustion of fuel vapor above the fluid bed is to be expected, usually resulting in a temperature increase of 100° F. to 150° F. above the fluid bed temperature, hence exit gas temperature above a 1450° F. bed will be about 1550° F.–1600° F.

In addition to heat exchanger 78 used with the disengagement vessel outflow, I propose the use of steam tubes 92 directly in the fluid bed. Although it is impossible to put steam tubes throughout the fluid bed to remove heat, because the oversized inerts 57 moving through the fluid bed would shortly destroy the tubes due to impact, the tubes 92 may be mounted around the outside wall of the combustion chamber 12 to take advantage of the high heat transfer coefficients (up to five times higher) of tubes in contact with the turbulent fluid bed.

All of the hot gas leaving the fluid bed 16, opening 86 and nozzles 90 passes through the convection tube bank 94 where it is cooled and the heat is transferred for the purpose of making saturated steam or superheated steam. Cooled combustion gases laden with dust are removed from the combustor through the opening 96 by an induced draft fan (not shown) and passed through a baghouse (not shown) or equivalent device to remove the particulate prior to being expelled to the atmosphere. No wet scrubbing of the flue gas is required to remove residual acid gas pollutants as their suppression occurs entirely within the fluid bed combustor.

It should be understood that the present disclosure has been made only by way of example, and that numerous changes in details of construction and the combination and arrangement of parts may be resorted to without departing from the true spirit and scope of the invention as hereinafter claimed.

What is claimed:

1. In a bubbling-type fluid bed combustion apparatus including a combustion chamber, an air pervious support within said chamber, a quantity of finely divided inert particles disposed upon said support, means for introducing a supply of air into said chamber beneath said support for forming a bubbling-type fluid bed of said inert particles having a distinct surface, means for heating said inert particles to a temperature above the ignition temperature of a combustible material, means for delivering said combustible material into said chamber onto said distinct surface of said fluid bed, and means for venting the products of combustion out of said chamber, the improvement comprising:

means for removing a portion of said inert particles from said fluid bed, and means for transporting said portion of said inert particles including, means for cooling said portion of said inert particles to a temperature below the ignition temperature of said combustible material, and means for delivering said cooled portion of said inert particles atop said delivered combustible material so as to submerge said combustible material beneath said distinct surface of said fluid bed.

2. The fluid bed combustion apparatus as defined in claim 1 including means for defining a localized input zone within said chamber into which said delivered combustible material is confined, and wherein said means for delivering terminates above said localized input zone.

3. The fluid bed combustion apparatus as defined in claim 2 including an opening in the side of said chamber opposite to said localized input zone for removing said portion of said inert particles, and wherein said means for transporting comprises an upwardly directed passageway and means for delivering a supply of air to said passageway for moving said portin of said inert particles to an elevated location above said fluid bed.

4. The fluid bed combustion apparatus as defined in claim 3 wherein said air pervious support comprises means for imparting a vector to said supply of air introduced into said chamber so as to move large uncombusted portions of said combustible material to said opening.

5. The fluid bed combustion apparatus as defined in claim 1 wherein said means for cooling comprises a heat exchanger.

6. The fluid bed combustion apparatus as defined in claim 1 further including means for providing at least one transport air jet beneath the surface of said fluid bed for laterally moving said submerged combustible material through said fluid bed.

7. The fluid bed combustion apparatus as defined in claim 6 including means for defining a localized input zone within said chamber into which said delivered combustible material is confined, and wherein said means for delivering terminates above said localized input zone, and wherein said means for providing at least one transport air jet is located beneath said localized input zone.

8. The fluid bed combusting apparatus as defined in claim 1 further including means for adding limestone or dolomite to said fluid bed.

9. A method of combusting waste material in a fluid bed combustion chamber comprising the steps of providing a bed of finely divided inert particles.

fluidizing said bed of particles with an upwardly directed stream of air, heating said bed of particles to a temperature above the ignition temperature of said waste material, depositing said waste material atop said fluid bed at a localized zone, withdrawing a portion of said bed of particles, cooling said portion of said bed of particles to a temperature below the ignition temperature of said waste material, transporting said cooled particles to a location above said localized zone, dropping said cooled particles atop said deposited waste material so as to submerge said waste material below the surface of said fluid bed, and combusting said waste material within said fluid bed.

10. The method of combusting waste material in a fluid bed combustion chamber as defined in claim 9 including the further step of dispersing said submerged waste material throughout said fluid bed by introducing at least one lateral air jet below the surface of said fluid bed.

11. The method of combusting waste material in a fluid bed combustion chamber as defined in claim 10 wherein said step of fluidizing is accomplished by introducing said air upwardly with a lateral velocity vector so as to move uncombusted waste material toward a withdrawal zone.

12. The method of combusting waste material in a fluid bed combustion chamber as defined in claim 9 wherein said step of transporting is accomplished by confining an upwardly directed air stream within a passageway and by introducing said portion of said bed of particles into said passageway so as to be entrained in said upwardly moving air stream.

* * * * *